United States Patent [19]

Griffin et al.

[11] 4,408,791

[45] Oct. 11, 1983

[54] GAS PUMP LEVER HOOK MEMBER

[76] Inventors: James E. Griffin; Lamar H. Griffin, both of 4746 Memphis St., Dallas, Tex. 75207

[21] Appl. No.: 238,847

[22] Filed: Feb. 27, 1981

[51] Int. Cl.[3] ..... A47F 13/08

[52] U.S. Cl. ..... 294/1 R; 239/526; 294/24

[58] Field of Search ..... 239/526, 525; 141/206, 141/209; 294/26, 1 R, 24

[56] References Cited

U.S. PATENT DOCUMENTS 3,076,608 2/1963 Valles ..... 239/526

3,520,338 7/1970 Vest et al. ..... 141/206

*Primary Examiner*—James B. Marbert

*Attorney, Agent, or Firm*—Hubbard, Thurman, Turner & Tucker

[57] ABSTRACT

A gas pump lever hooking member including an elongated member with a first end having a pair of spaced apart claw portions forming reentrant edges of a slot shaped so as to be adapted to engage the lever and hold it in an open position against a pump handle. A second end of the hooking member is adapted to serve as an ice scraper for an automobile windshield. The elongated member has a hand grip recess midway between the first and second ends.

5 Claims, 3 Drawing Figures

GAS PUMP LEVER HOOK MEMBER

BACKGROUND OF THE INVENTION

The present invention relates broadly to a hooking member for holding a gas pump valve open and in particular to a gas pump lever hook member wherein the pump valve lever is squeezed against the body of a gasoline pump handle permitting gasoline to flow at a maximum rate through the handle and into an automobile or truck gas tank.

Conventional gas pumps include a nozzle with a housing in which is mounted a valve apparatus for regulating the flow of fuel through the nozzle. The nozzle is provided with a manually operable lever whereby the valve apparatus can be opened to permit the discharge of fuel from the nozzle. The lever is normally biased, for example, by spring means, to a position wherein the valve apparatus is closed. Typically, prior art nozzles also include an automatic closing device such that fuel flow through the nozzle will be terminated when the tank is filled thereby preventing fuel overflow and spillage. Such automatic closure apparatus is typically independent of the manual operation of the lever and substantially releases the bias on the lever when the apparatus is actuated. Additionally, some gas pump nozzles are provided with a means attached thereto to hold the lever in the open position against the biasing force that tends to close the valve. Such means typically is a bar mounted to the nozzle with several notches therein in which is received the posterior end of the lever. Another prior art lever retention means is a stop pivotally attached to the lever for engagement with a plurality of stop surfaces on the guard or handle surrounding the lever.

Some gas pump nozzles are not provided with any means for retaining the lever in the open position. Additionally, in self-service gas station operations, it is not uncommon for the station owner to simply remove the lever retention means from the nozzle. Thus the vehicle owner utilizing the self-service station finds that he must continually apply manual pressure to the lever to hold the nozzle open until the gas tank is filled.

Additionally, it is not uncommon for the pump lever to simply slip out of the prior art retention means thereby closing the fuel valve and shutting off fuel flow. Under continued use for extended lengths of time due to mechanical wear and tear, the prior art retention means become less and less effective. When the lever does in fact slip from the grasp of the prior art retention means, it is a nuisance to the gas station attendant or operator who at the time may be performing other maintenance functions concerning the vehicle.

It is desirable, therefor, to have a device that holds the gas pump nozzle open so that the vehicle operator or station attendant can perform other tasks, such as checking the oil level of the vehicle, etc. It is also desirable to have such a hooking member device that can be particuarly convenient if it were combined with an ice scraper on one end so that the overall length of the member does not greatly exceed the length of an ordinary ice scraper such as would be carried in the glove box of an ordinary automobile.

The present invention provides these desirable features in that it is a gas pump lever hooking member that positively retains the lever in the open position against a closing biasing force. The hooking member of the present invention is designed so that it can be positioned to hold the lever open at a position corresponding substantially to the maximum fuel flow rate through the gas pump nozzle. Although the present invention can be utilized by the station attendant to eliminate the problems associated with the prior art lever retention means discussed above, it is particularly useful to the individual motor vehicle operator and can be easily carried in the vehicle and made readily accessible for use thereof. In addition, the member is wide enough to allow ample room for the presentation of commercial advertising on at least one of its smooth faces.

SUMMARY OF THE INVENTION

The present invention is a hooking member for maintaining a gas pump valve in substantially the maximum open position. The pump includes a valve actuating lever that is normally biased closed and a generally tubular fluid conveying handle disposed adjacent to the lever. The hooking member is an elongated member with first and second ends disposed along an elongation axis. The first end has a means for engaging the gas pump lever and the elongated member advantageously includes a second means disposed on the second end for chipping ice from vehicle windshields.

In the preferred embodiment, the first means for engaging the lever includes a slot defined by upper and lower claw shaped portions forming reentrant edges of the slot. The slot has an upper surface conforming generally to a portion of the cross sectional shape of the tubular pump handle and a lower recess defined by a surface conforming to at least a portion of the cross sectional shape of the pump lever. The upper and lower surfaces of the slot are spaced apart so as to provide for substantially the maximum rate of fuel flow through the gas pump nozzle when the hooking member engages the lever and holds it against the fluid conveying handle of the gas pump. Moreover, the reentrant edges of the slot provided by the claw portions retain the hooking member on the pump nozzle even when the automatic closure apparatus actuates the valve to close thereby reducing the bias force on the pump lever.

In the preferred embodiment of the present invention, the hooking member has a relatively sharp ice cutting edge disposed along its second end.

The hooking member of the present invention is sized to engage the lever generally proximate the mid-point of the lever as opposed to engagement at the end of the lever. The normal closing biasing force is, in fact, the force which functions to retain the hooking member so that it firmly holds the lever against the fluid conveying handle of the gas pump, whereas in the prior art retention means the biasing force acted on the retaining member out of engagement with the lever or the guard.

Thus, the present invention provides a hooking member which positively retains the gas pump valve open in one position corresponding substantially to the maximum fuel flow rate. The hooking member of the present invention substantially eliminates the problems of the prior art retention means that are subject to nuisance closings of the gas pump nozzle. The present invention is conveniently carried in the vehicle or by the vehicle operator. The hooking member frees the vehicle operator or the gas station attendant using it so that other maintenance checks concering the vehicle can be made while the fuel tank is being filled. In addition, the presence of an ice scraper at one end of the hooking member is advantageous and assures that the vehicle operator will have an ice scraper available to him when the occasion for its use arises. Finally, the frequent use of the hooking member assures that any advertising displayed thereon will receive angular exposure. These and other advantages of the present invention will become apparent with reference to the accompanying drawings, detailed description of the preferred embodiment, and claims.

DETAILED DESCRIPTION OF THE PREFERRED EMBODIMENT

Figure 3:
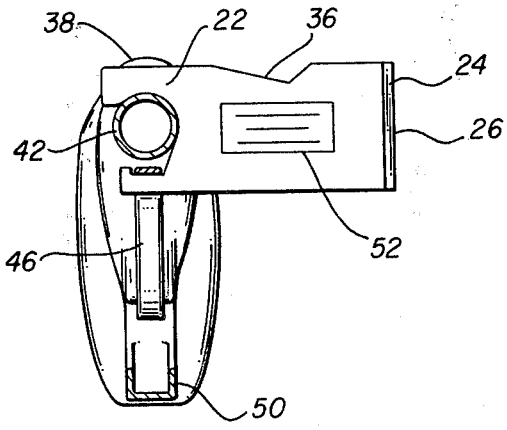
FIG. 3 is a sectional view taken generally along lines 3—3 of FIG. 2.

Referring to the drawing, wherein like numerals represent like parts throughout the several views, the gas pump lever hooking member of the present invention is designated generally as 10. Hooking member 10 is an elongated generally rectangular flat platelike member 12 having an elongation axis along which are disposed a first end 14 and a second end 16. First end 14 has a pair of projecting claw portions 18 and 20 which are generally parallel to the elongation axis of member 12. The projecting claw portions 18 and 20 form reentrant edges of a slot which, as shown in FIG. 3, includes an upper retaining surface 22 conforming generally to the cross sectional contour of a fluid conveying handle of the gas pump as will be described in more detail hereafter. The slot is also defined by a lower surface portion 23 which conforms somewhat to the cross sectional shape of the pump nozzle lever and is spaced from the upper surface sufficiently to hold the lever in a substantially maximum open position of the valve.

Means are advantageously provided on elongated member 12 for scraping ice from the windshield of a conventional automobile. In a preferred embodiment, elongated member 12 has a wedge shaped edge 24 on the second end thereof, which defines a sharp cutting surface 26 that is perpendicularly disposed with respect to the elongation axis of member 12. Alternative structures which provide similarly perpendicularly disposed ice scraping surface are also contemplated within the spirit and scope with the present invention.

At an edge parallel to the elongation axis and located approximately midway between the first and second ends of elongated member 12 is a hand grip portion 36. Hand grip portion 36 may be attached to elongated member 12 by any convenient means such as a suitable adhesive. It may also be an integral part of elongated member 12 and may consist of a smooth and shallow wedge shape cut taken from the side of elongated member 12. The hand grip is rounded and smooth to provide a comfortable yet secure grip.

Figure 1:
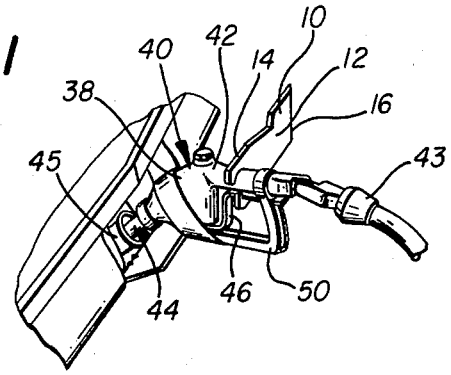
FIG. 1 is a view in perspective of the gas pump lever hooking member of the present invention.
Figure 2:
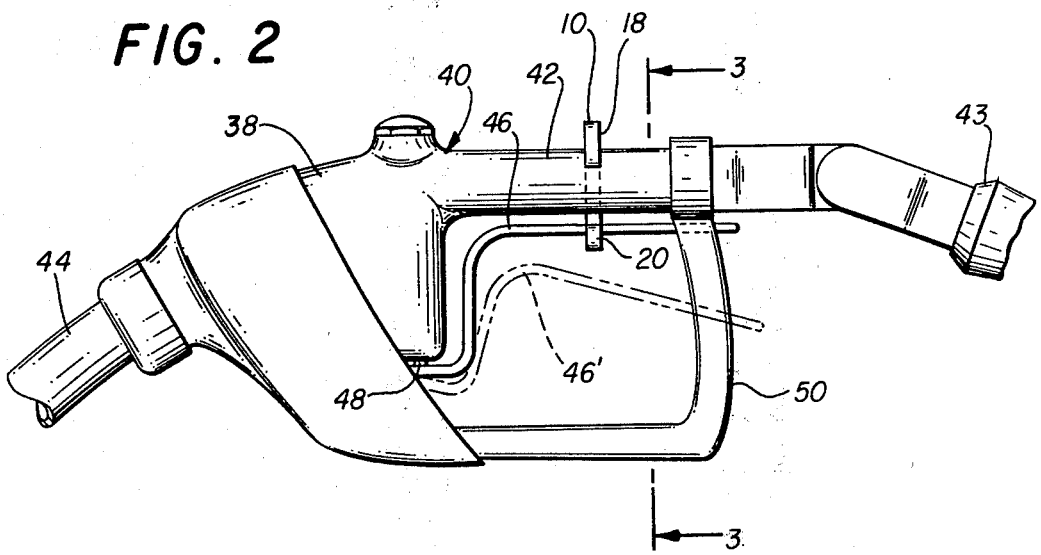
FIG. 2 is a plan view illustrating the operation of the gas pump lever hooking member of the present invention in conjunction with a conventional prior art gas pump nozzle.

FIGS. 2 and 3 illustrate the operation of the gas pump lever hook member 10. A portion of a gas pump nozzle, incorporating the valve mechanism, is shown generally at 38. Gas pump nozzle 38 includes a housing 40 which contains the valve mechanism that includes an automatic shut-off means to prevent gas overflow from a filled tank. Nozzle 38 has a generally tubular shaped fluid conveying handle portion 42 connected by flexible hose 43 to the gas pump, not shown. An end 44 of nozzle 38 has an extension which is placed into the gas tank opening 45. Nozzle 38 includes a manually operable lever 36 which is movable between a fully closed position as shown by the dashed lines at 46' to the substantially fully opened position illustrated in FIG. 3. Lever 46 is pivotally mounted to housing 40 and is in contact with a valve actuating rod, the end of which is shown at 48. Rod 48 is typically spring biased to urge lever 46 toward the fully closed position at 46'. Pump nozzle 38 also includes a lever guard 50 which is disposed generally about lever 46. It will be understood that gas pump nozzle 38 is a conventional prior art structure and does not form a part of the present invention. The present invention of a gas pump lever hooking member 10 is specifically designed to be used with any such conventional prior art gas pump apparatus.

When it is desired to fill one's tank while at the same time performing other activities, such as other preventative maintenance checks on the automobile or vehicle, the nozzle extension from end 44 is placed within the opening of the gas tank. Lever 46 may then be manually operated against the spring biasing force thereby opening the valve permitting gas flow into the tank. Hooking member 10 is positioned such that lever 46 is received within the lower portion of a slot comprising a notch or recess formed by projecting claw portion 20. Together lever 46 and the tubular fluid conveying handle portion 42 are disposed within the slot and in contact with lower surface 23 and upper retaining surface 22, respectively. Hooking member 10 thereby holds lever 46 in the open position against the biasing force tending to urge lever 46 to the close position at 46'.

As previously mentioned, hand grip 36 is provided as a convenient means for holding the hooking member 10 while it is being hooked to the gas pump lever and handle or while it is being used to scrape ice from a conventional vehicle window. An advertising message 52 may be impressed into member 12 so that hooking member 10 can function as an advertising conveyance. In the preferred embodiment, hooking member 10 is molded of a suitable plastic material. It will be understood, however, that any sufficiently rigid material may be utilized within the spirit and scope of the present invention.

From the above description, it can be seen that the present invention is a convenient means to facilitate filling a gas tank while the vehicle operator performs other maintenance and inspection services. Hooking member 10 is particularly convenient in self-service gas pump operations. Gas pump nozzle 38 as previously mentioned, has an automatic shut-off which is independent of the operations of lever 46. Thus, hooking member 10 may be utilized as described herein without concern of a tank overflow. Moreover, the provision of the claw portions 18 and 20 and the opposed surfaces 22 and 23 provide superior means for retaining the hooking member on the pump nozzle. Hooking member 10 is of a size and configuration which permits storage where it will be made readily accessible to the vehicle operator and provides convenient means to fill his gas tank, particularly at self-service stations that are rapidly increasing in number as the cost of fuel also increases.

What is claimed is:

1. A gas pump lever hooking member for use with a gas pump having a nozzle, a valve for regulating gas flow through the nozzle, a manually operable lever arm to open the valve, means for biasing the lever arm in a position whereby the valve is normally closed, and a fluid conveying handle disposed about the lever arm, said hooking member comprising:

an elongated generally rectangular member having first and second ends and opposite edge portions, at least one of said edge portions including means providing a hand grip; and one of said ends including a wedge shaped ice scraping surface formed thereon;

a pair of opposed claw portions formed at the other of said ends and spaced apart from each other a distance slightly greater than the combined width of the lever arm and the fluid conveying handle to define a slot sized to receive the lever arm and the fluid conveying handle whereby the lever arm is held in substantial proximity to the fluid conveying handle against the biasing means by said claw portions, said claw portions being releasably engageable with the lever arm and the fluid conveying handle at a point spaced apart from the end of the lever arm, and said claw portions forming reentrant edges of said slot to prevent said hooking member from falling off of said pump nozzle.

2. A gas pump lever hook member for use with a gas pump having a nozzle, a valve for regulating gas flow through the nozzle, a manually operable lever arm to open the valve, means for biasing the lever arm in a position whereby the valve is normally closed, and a fluid conveying handle disposed about the lever arm, said hook member comprising:

an elongated member having an elongation axis, first and second ends disposed perpendicularly from said elongation axis, and opposite edge portions, one of said edge portions being parallel to said elongation axis and having a hand grip form spaced midway along said edge; and a pair of claw portions projecting from said first end and spaced apart at a distance slightly greater than the combined width of the lever arm and the fluid conveying handle to define a slot sized to receive the lever arm and the fluid conveying handle, said slot having an upper surface and a lower surface substantially conforming, respectively, to portions of the cross-sectional contour of said fluid conveying handle and the lever arm whereby the lever arm is held in substantially proximity to the fluid conveying handle against the biasing means with said claw portions releasably engaged around the lever arm and the fluid conveying handle at a point spaced apart from the end of the lever arm.

3. A hooking member in accordance with claim 2 wherein:

said claw portions define an opening in said slot only slightly larger than the width of the fluid conveying handle.

4. A hooking member in accordance with claim 3 wherein:

said claw portions further define a slot having a vertical interior dimension slightly greater than the combined width of the fluid conveying handle and the lever arm.

5. A gas pump lever hooking member for use with a gas pump having a nozzle, a valve for regulating gas flow through the nozzle, a manually operable lever arm to open the valve, means for biasing the lever arm in a position whereby the valve is normally closed, automatic valve shutoff means operable to substantially reduce the bias on said lever arm, and a tubular fluid conveying handle disposed adjacent to said lever arm, said hooking member comprising:

an elongated flat platelike member having first and second spaced apart end portions and upper and lower edge portions, respectively, said upper edge portion including a recess defining a hand grip spaced substantially midway between said first and second end portions;

said first end portion including means defining a slot including upper and lower claw portions forming reentrant edges of said slot which are spaced apart to define an opening into said slot slightly greater in width than the combined width of said lever arm and said tubular handle portion, said slot being further defined by an upper surface conforming generally to at least a portion of the cross sectional contour of said tubular handle and a lower recessed surface spaced from said upper surface a distance sufficient to engaging said lever arm to hold said lever arm in a normally open position of said valve, said reentrant edges of said slot being operable to prevent said hooking member from falling off of said gas pump nozzle when said bias on said lever arm is reduced by said automatic shutoff means.

* * * * *